United States Patent [19]

Miller

[11] 4,050,588

[45] Sept. 27, 1977

[54] AUTOMATIC MINE CAR COUPLING

[75] Inventor: Harry Miller, Scott Depot, W. Va.

[73] Assignee: Lester Construction Co., Hurricane, W. Va.

[21] Appl. No.: 679,765

[22] Filed: Apr. 23, 1976

[51] Int. Cl.[2] ..... B61G 1/36

[52] U.S. Cl. ..... 213/75 B; 213/81; 213/92; 213/101; 213/177

[58] Field of Search ..... 213/75 B, 81, 92, 101, 213/159, 161, 164, 165, 177, 186, 196; 280/510

[56] References Cited

U.S. PATENT DOCUMENTS

| | | | |
|---|---|---|---|
| 275,177 | 4/1883 | Eyl | 213/177 |
| 534,660 | 2/1895 | Palmer | 213/92 |
| 599,883 | 3/1898 | Turk et al. | 213/177 |

FOREIGN PATENT DOCUMENTS

| | | | |
|---|---|---|---|
| 532,599 | 8/1955 | Italy | 213/81 |

*Primary Examiner*—Trygve M. Blix
*Assistant Examiner*—Sherman D. Basinger
*Attorney, Agent, or Firm*—Gipple & Hale

[57] ABSTRACT

A mine car coupling assembly comprising a spring biased receiving assembly having a pair of jaw members mounted about a pivot point. The forward ends of the jaw members are beveled and tapered inwardly to form a hook configuration adapted to receive and hold an arrowhead shaped male member. Each jaw member's forward end is biased toward the other jaw member's forward end by a spring assembly mounted to both of the jaw members. The tip of the arrowhead member initially engages the jaw members of the receiving assembly and overcomes the spring assembly's force, forcing the jaw members apart. When the arrowhead has entered into the receiving assembly the hook ends are urged back toward each other by the spring assembly to engage the rear surface of the arrowhead member and hold the arrowhead member in position within the receiving assembly. The arrowhead member is released from the receiving assembly through a release mechanism comprising a slidable latch block which carries a movable wedge adapted to fit over the arrowhead member. The wedge is moved to engage the jaw members spreading them apart so that the arrowhead member can be removed from the receiving assembly to uncouple the cars.

17 Claims, 15 Drawing Figures

Fig. 6.
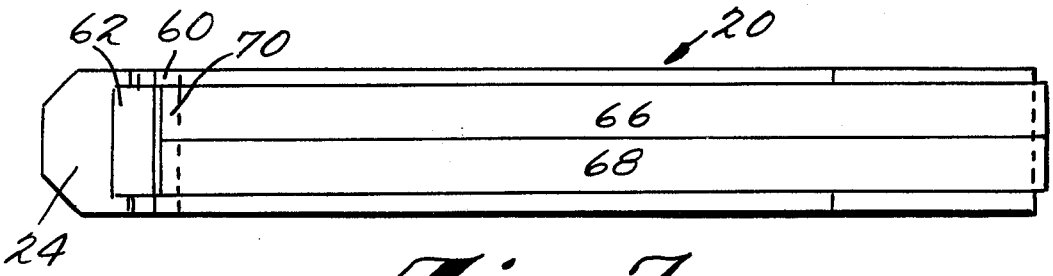
Fig. 7.
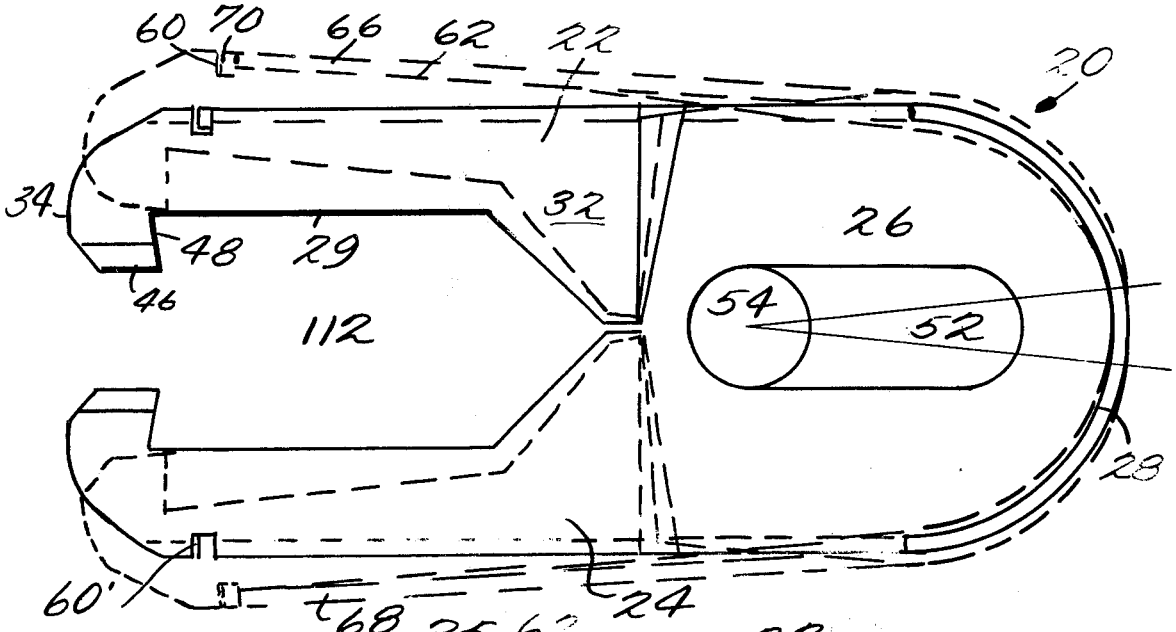
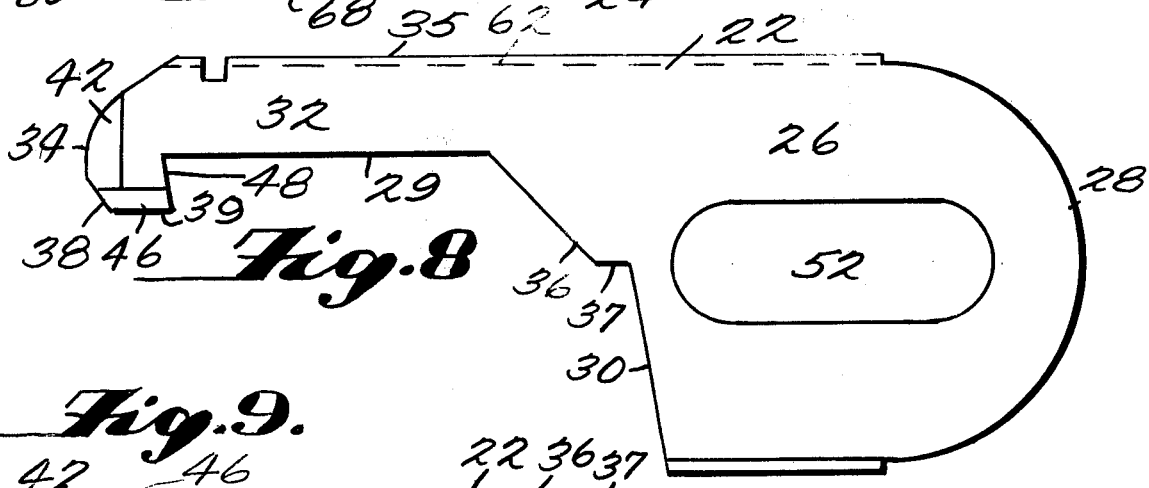
Fig. 8
Fig. 9.
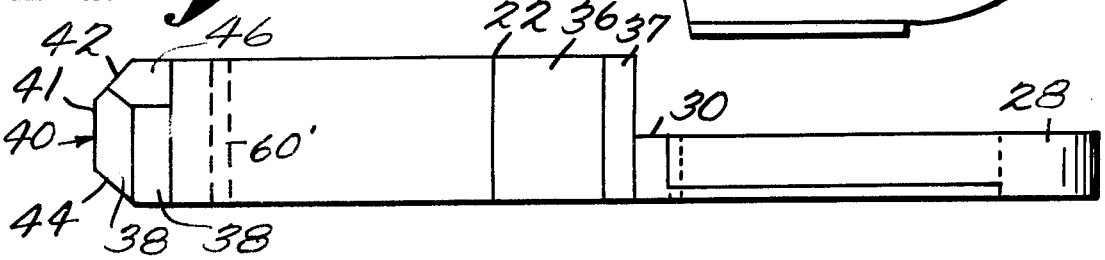

AUTOMATIC MINE CAR COUPLING

The present invention generally pertains to a mine car coupling device and particularly pertains to an automatic uncoupling device combined with an arrowhead latching mechanism.

BACKGROUND OF THE INVENTION

In previous commercial applications mine cars have been connected together through the use of pins which are removed by hand to uncouple the individual cars. When the cars are desired to be coupled they are aligned and the coupling pin is dropped into an aperture alignment to hold the cars together.

DESCRIPTION OF THE PRIOR ART

Various automatic mine car coupling devices utilizing an arrow shaped male member on one end of the car and a pivoting spring biased female receiving assembly on an adjacent car are known in the art. One U.S. Pat. No. 599,883 discloses a single pivoted spring biased receiving assembly which is adapted to yield and receive an arrow shaped head of a coupling bar. A cam device is positioned within the jaws of the receiving assembly so that when a handle is pulled, the cam is turned pushing the jaws of the receiving assembly back against end springs to release the arrow shaped head of the coupling bar.

Another U.S. Pat. No. 425,001 disclosed a double pivoted receiving assembly which is spring biased and operates in substantially the same manner as the previously mentioned U.S. Pat. No. 599,883. The jaw members of the receiving assembly are beveled and have shoulders which engage similar shoulders on the coupling link so that the coupling link is held by the coupling jaw members. Similarly, U.S. Pat. No. 2,248,005 discloses a single pivoted, two jaw member spring biased coupling device adapted to receive an arrowhead shaped male member. The rear walls of the remaining portions of the jaw members are inclined at an angle so that the entire rear wall surface does not engage the back of the coupling bar's conical head.

Also of interest is U.S. Pat. No. 230,458 which discloses a double pivoted coupling device similar to that shown in U.S. Pat. No. 425,001. This coupling is provided with a pivotable lever mounted above the receiving assembly and adapted to engage the receiving assembly to force the arms of the receiving assembly apart so that the arrowhead shaped male member can be retracted.

In addition the following U.S. patents are noted in that they pertain to an arrowhead type car coupling. U.S. Pat. Nos. 40,966; 80,735; 142,998; 229,660; 534,660; 591,927; 948,205; 1,610,902; and 2,124,467.

The present invention differs from the known prior art in that it is of a simple, sturdy construction, requiring relatively little maintenance and because of its simple construction it is highly dependable with a low breakage rate. The elimination of pivot pins, levers and other components significantly reduces breakage and metal strain which can lead to serious accidents. Furthermore the present invention conforms with present mine safety laws and allows cars to be easily coupled and uncoupled from the train with the additional benefit that cars from sidings which are placed in reverse position can be coupled into the train by reversing coupling components.

SUMMARY OF THE INVENTION

The present invention comprises a spring biased receiving assembly having a pair of jaw members mounted about a pivot point. The forward ends of the jaw members are beveled and tapered inwardly to form a hook shaped configuration adapted to receive and hold an arrowhead shaped male member. Each jaw member's forward end is urged toward the other jaw member by either a coiled spring mounted to the rear end of each jaw member or a U-shaped band spring assembly mounted around the jaw members in a channel cut in the jaw members. The tip of the arrowhead member initially engages the forward ends of the jaw members and overcomes the spring bias, forcing the jaw members apart allowing the arrowhead member to enter into the receiving assembly. The hook shaped ends are urged back toward each other by the spring after the arrowhead member has passed by the hook shaped ends, and the ends engage the rear surface of the arrowhead member and hold the arrowhead member in position within the receiving assembly.

The arrowhead member is released from the receiving assembly through a release mechanism comprising a slidable latch block which carries a moveable wedge adapted to fit over a "T" stem of the arrowhead member and engages the jaw members of the receiving assembly. The jaw members are forced apart by the wedge so that the arrowhead member can be removed from the receiving assembly to uncouple the cars.

Although the invention will be set forth in the claims, the invention itself and the manner in which it may be made and used, may be better understood by referring to the following description taken in connection with the accompanying drawings forming a part thereof in which like reference numerals refer to like parts throughout the several views and in which:

BRIEF DESCRIPTION OF THE DRAWINGS

FIG. 6 is a side elevational view of the preferred receiving assembly embodiment;

FIG. 7 is a plan view of the receiving assembly as shown in FIG. 6 showing the jaw members extension in phantom;

FIG. 8 is a plan view of one of the jaw members shown in FIG. 7;

FIG. 9 is a side elevational view of the jaw member shown in FIG. 8;

DETAILED DESCRIPTION OF THE DRAWINGS

Figure 4:
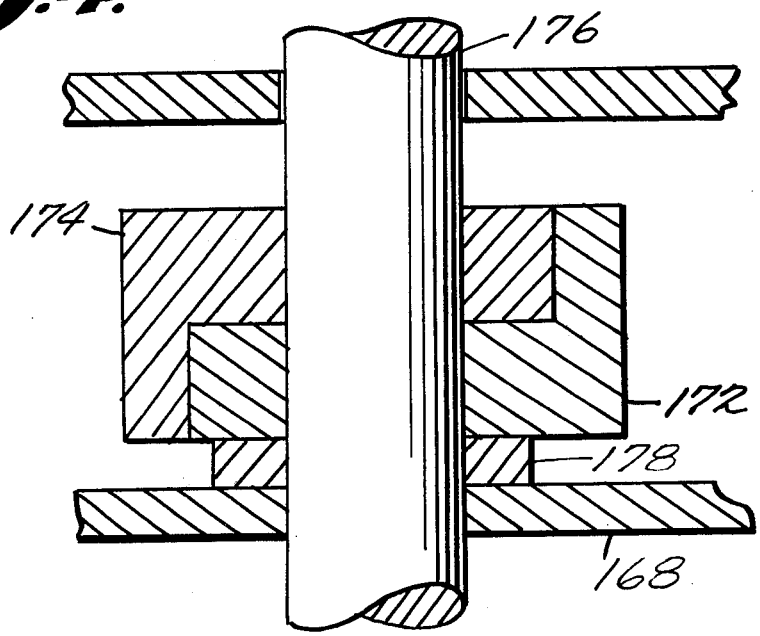
FIG. 4 is an enlarged cross-sectional view taken along line 4' — 4' of FIG. 2 when the alternate receiving assembly of FIG. 5 is substituted for the receiving assembly of the preferred embodiment.

The preferred embodiment of the invention is disclosed in FIGS. 6 through 15. In the preferred embodiment a receiving assembly 20 as is shown in FIGS. 6 and 7, comprises a right jaw member 22 and a left jaw member 24 which are identical in configuration. Both jaw members are adapted to fit against each other so that when combined the assembly works like a pair of pliers with the exception that there is a spring acting on the jaw members biasing them towards each other.

Each jaw member comprises a pivot section 26 defining an arcuate rear surface 28, an angled planar front surface 30, an arm section 32 having a forward end 34 generally shaped in a hook-like configuration and a rear end 36 which is angled with respect to the arm side walls 29 and 35. A side wall 37 having a surface parallel to the arm side wall 35 terminates arm rear end 36. Each forward end 34 has an inner rearwardly tapering surface 38 abutting hook side wall 39 and a front surface 40 formed by a vertical wall 41 and two adjacent bevelled surfaces 42 and 44. The top inner surface 46 of the hook portion is bevelled to receive a wedge member as will be later described in the specification and is bounded by surface 38 and an inclined rear wall 48. The rear wall 48 is preferably cut at an 8° angle to the perpendicular of the inner arm wall 29 to form a retaining surface for the back wall of an arrowhead member 80. An oval shaped aperture 52 is defined by the pivot section 26 and is adapted to receive a pivot member such as an anchor pin 54 which is pushed into the respective aperture 52 of the two jaw members 22 and 24 so that the jaw members pivot around the pin 54.

The outer surface of arm side wall 35 defines a vertical cut or recess 60 which is adapted to receive and hold the end of a band spring or other spring means. A spring channel 62 is also cut in the outer surface of the arm side wall and pivot section, which serves to hold the spring means which extend from one jaw recess 60 to the other jaw recess 60'. The channel 62 is cut into the jaw members and is designed to hold U-shaped band springs 66 and 68 both of which have flanged ends 70 designed to fit into the recesses 60 and 60' which hold the springs when the jaws are moved.

Two separate U-shaped band springs are used to allow the assembly to hinge and if the pivot pin is in the forward position of the aperture 52 then the springs 66 and 68 will allow the assembly to pivot in and out. It should be noted that during coupling the pivot pin 54 is at the front end towards the jaws in the elongated aperture 52.

Figure 1:
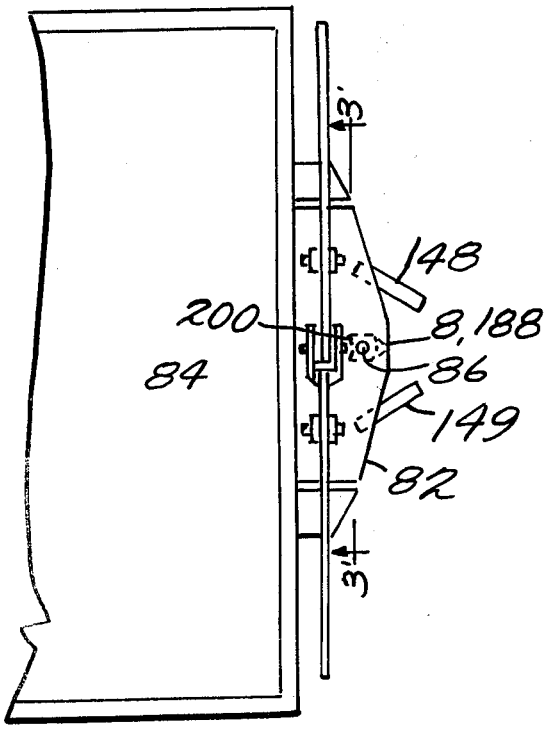
FIG. 1 is a top plan view partially in section of a portion of one end of a mine car with the arrowhead member and an uncoupling mechanism.

The receiving assembly 20 is adapted to receive an arrowhead member 80 which is mounted to a bracket 82 or mine car bumper extending from the mine car 84 by a pin means 86 as is shown in FIG. 1. The arrowhead shaped member 80 is constructed with a body portion 88 and a rounded T stem 90 extending from the body portion. The body 88 defines an aperture 92 which is adapted to receive a coupling pin 86 which fits through the aperture 92 and a similarly aligned aperture on the bracket 82 so that the arrowhead member is held in place. The arrowhead body is formed with a camming front surface 96 formed by two intersecting angled front surfaces 98 and 100. The body member 88 also has parallel side walls 102 and 104. Rear walls 106 and 108 terminate the parallel side walls 102 and 104 respectively and angle inwardly back in toward the center of the body where they are terminated by a T stem support 110. It should be noted that the rear walls 106 and 108 are preferably cut at an 8° angle inwardly with respect to the perpendicular to the outer surface of walls 102 and 104. The rear walls therefore will correspond with the inwardly cut rear surfaces 48 of the front end hooks of the receiving members. The mating of the respective surfaces 48, 106 and 108 allows the arrowhead member to be firmly held in place once it enters into cavity 112 defined by the arms of the jaw members of the receiving assembly 20.

Figure 10:
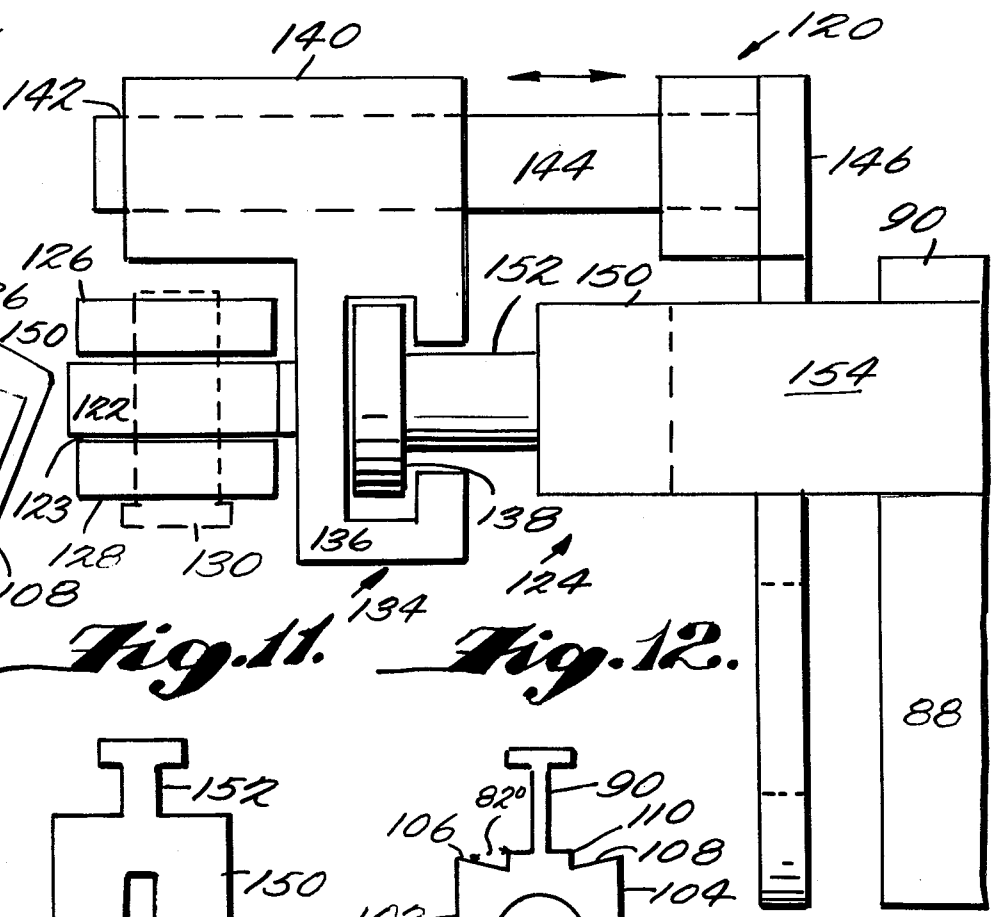
FIG. 10 is a plan view of the partially in section preferred uncoupling mechanism positioned on its side.
Figure 12:
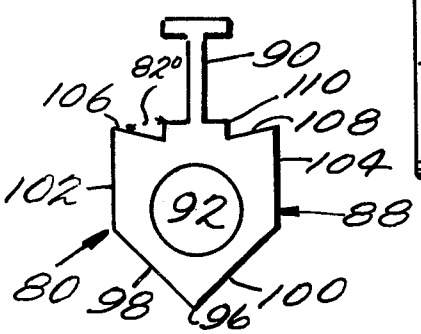
FIG. 12 is a plan view of the arrowhead member shown in FIG. 10.

A release mechanism 120 as shown in FIG. 10 is mounted above the T stem of the arrowhead member 80 and is adapted to extend the jaw members 22 and 24 away from each other past the parallel side walls 102 and 104 of the arrowhead member 80 so that the cars can be uncoupled from each other.

The release assembly 120 comprises a coupling bracket 122 defining a throughgoing aperture 123. The bracket 122 is secured to a latch block assembly 124. The bracket 122 is constructed to be connected to uncoupling arms 126 and 128 by pin means 130 which is inserted through aligned holes in the arms and bracket aperture 123 so that movement of the arms raises or lowers the bracket 122. The latch block assembly 124 comprises a support member or carriage member 134. The carriage member 134 is "L" shaped with one leg 136 defining one end of a T shaped slot 138 and the other leg 140 having an aperture 142 in which a guide post 144 is slidably positioned. The guide post 144 terminates and is secured to seat or base 146 which is mounted or secured to the mine car body or bumper. Extending from base 146 are two support guide arms 148 and 149 designed to guide the arms or jaw members 22 and 24 of the receiving assembly into place.

A wedge member 150 having a T shaped stem 152 with a cylindrical configures surface is designed to fit in the T shaped slot 138 of the latch block leg 136. The T shaped slot 138 is sized to allow stem 152 room to rotate so that the stem can assume various angles. The wedge member 150 has a pointed camming surface 154, similar to arrowhead member 80, defining a slot 156 having a width slightly greater than the T steam 90 of the arrowhead shaped member. It should be noted that when the ends of arms 126 and 128 are dropped the wedge member is raised up with the wedge always being in contact with the arrowhead member 80. Therefore, it does not make any difference at what angle the arrowhead member is coupled as the wedge rides in position at all times.

In operation, the uncoupling arms 126 and 128 of the release assembly 120 are moved so that the latch block assembly 124 is carried down the guide post 144 driving the wedge 150 down over the T stem 90 of the arrowhead member and against the inner beveled walls 46 of the jaw members 22 and 24, forcing them apart. As arms 126 and 128 ar moved the latch block 134 slides along the guide post 144 until the jaw members 22 and 24 have been forced apart a distance greater than the width between the side walls 102 and 104 of the arrowhead member 80. The arrowhead member attached to the mine car can then be withdrawn from the receiving assembly 20 so that the car is uncoupled.

A coupling of the two cars is accomplished by inserting the arrowhead member 80 into the receiving assembly 20 until body 88 is inserted into cavity 112 with the rear walls 106 and 108 of the arrowhead member abutting rear walls 48 of the jaw members.

In an alternate embodiment of the invention a slightly modified construction is used to accomplish the same result as previously described.

Figure 2:
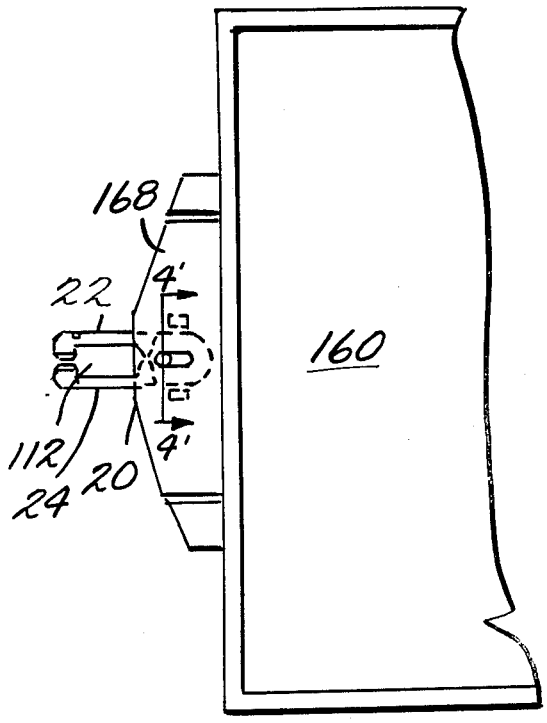
FIG. 2 is a top plan view partially in section of the opposite end portion of an adjacent mine car having a receiving assembly adapted to couple with the mine car shown in FIG. 1.
Figure 11:
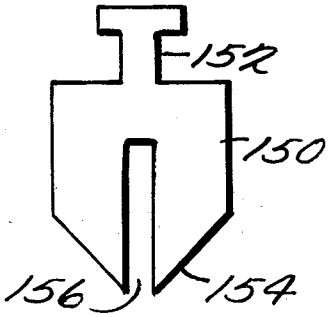
FIG. 11 is a plan view of the wedge member shown in FIG. 10.
Figure 13:
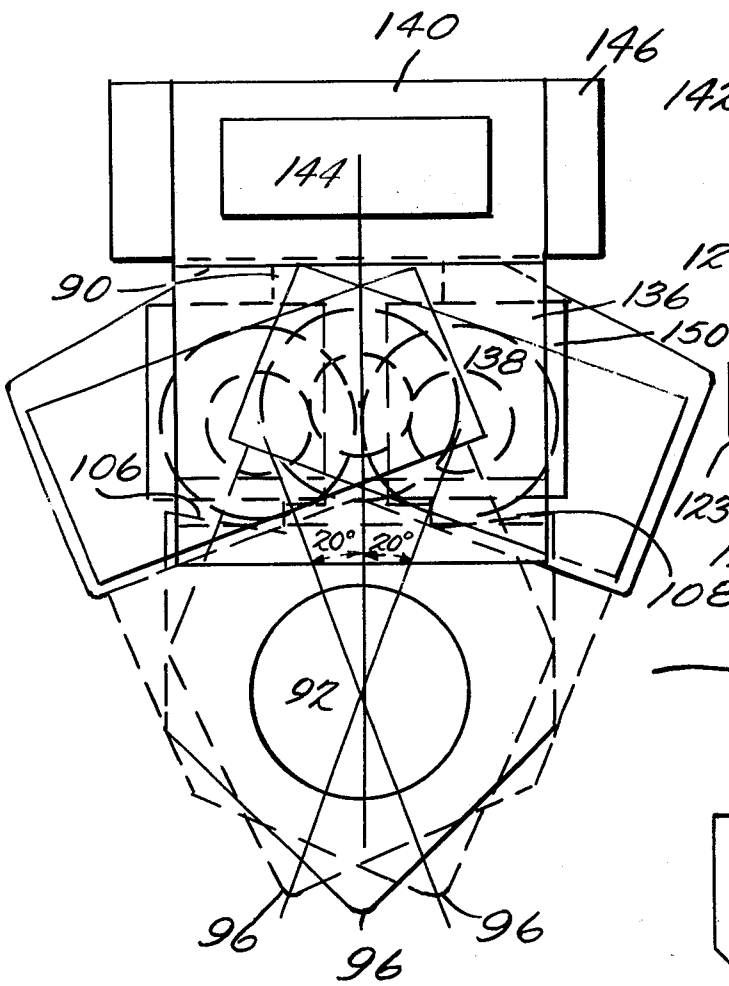
FIG. 13 is a top plan view of the mechanism of FIG. 10 when it is in operating position showing the positioning and movement of the wedge member and arrowhead member.
Figure 14:
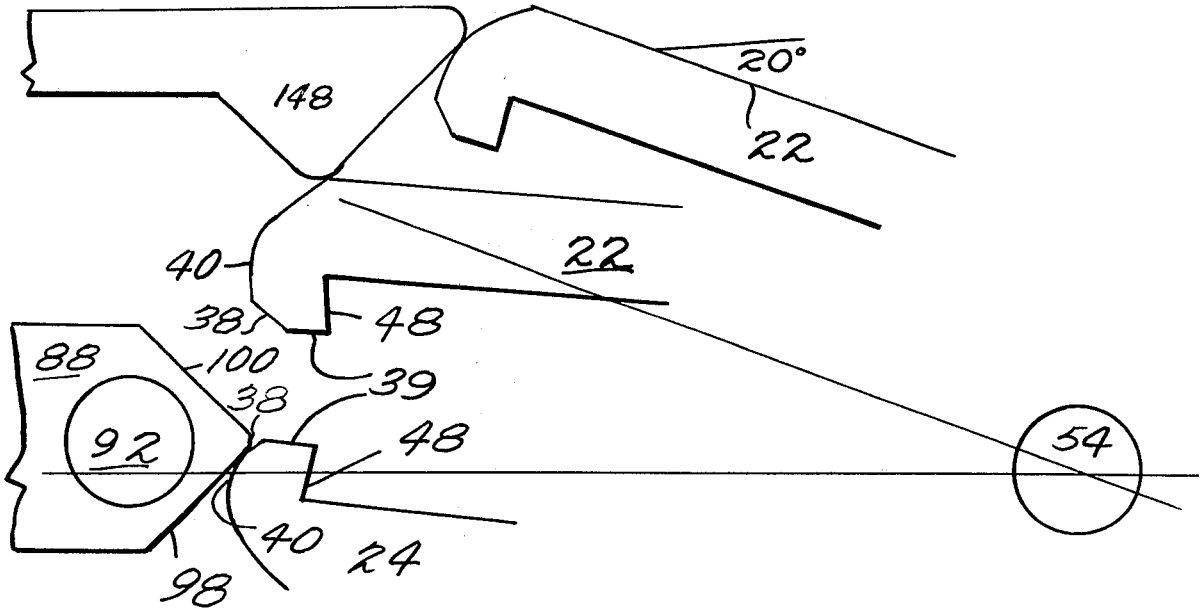
FIG. 14 is a schematic diagram showing the camming operation of the guide members when engaging the receiving assembly jaw members.
Figure 15:
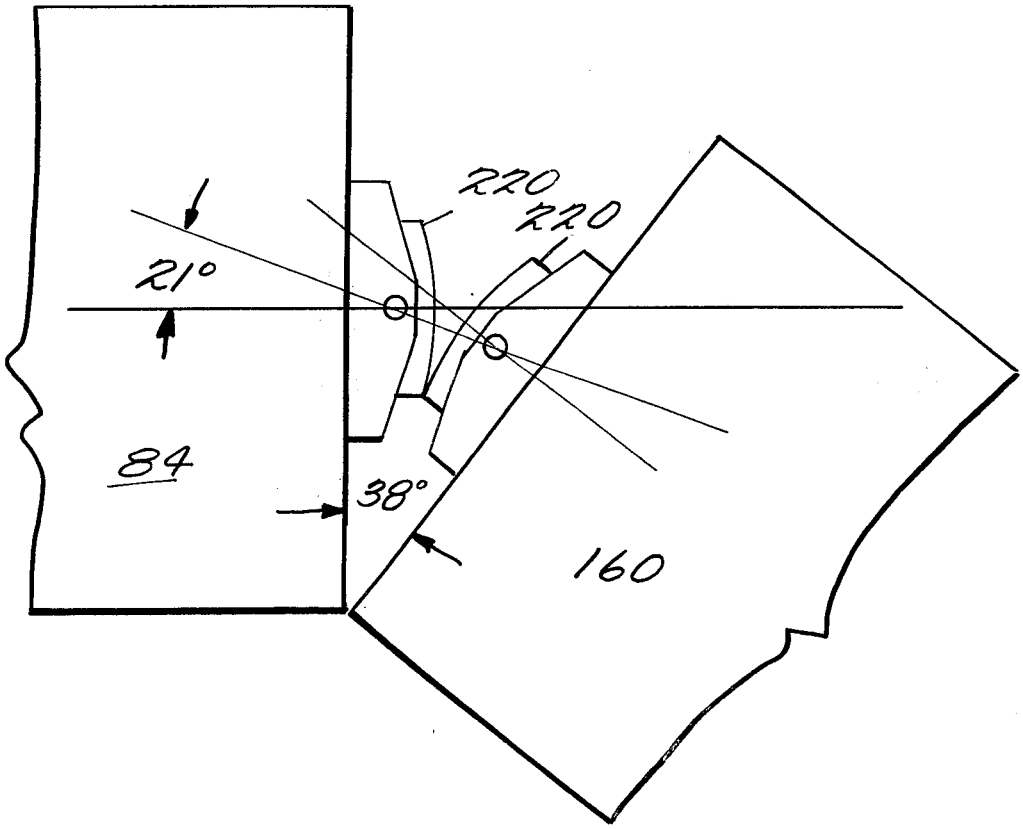
FIG. 15 is a top plan view of a typical mine car misalignment while traveling a typical track curve.

As is shown in the drawings, FIG. 1 represents one mine car 84 showing the alternate uncoupling assembly 121 and FIG. 2 represents another mine car 160 with the preferred latch receiving assembly 20. It will be appreciated however, that the receiving assembly of FIG. 5 can easily be substituted for the preferred receiving assembly 20 shown in FIG. 2. Conversely the unlatching assembly shown in FIGS. 10, 11 and 13 is preferably substituted for the uncoupling assembly 121 shown in FIG. 1 when latch receiving assembly 20 is used on an adjacent mine car. Both receiving assemblies 20 and 170 can be mounted by pin means onto the mine car bumper 168 as is shown in FIG. 2. Also both unlatching mechanisms can be mounted by pin means to the uncoupling arms.

The alternate receiving assembly 170 is constructed with the two locking arms or jaw members 172 and 174 which are pivotally mounted around a pin 176 as is shown in FIG. 4.

Figure 5:
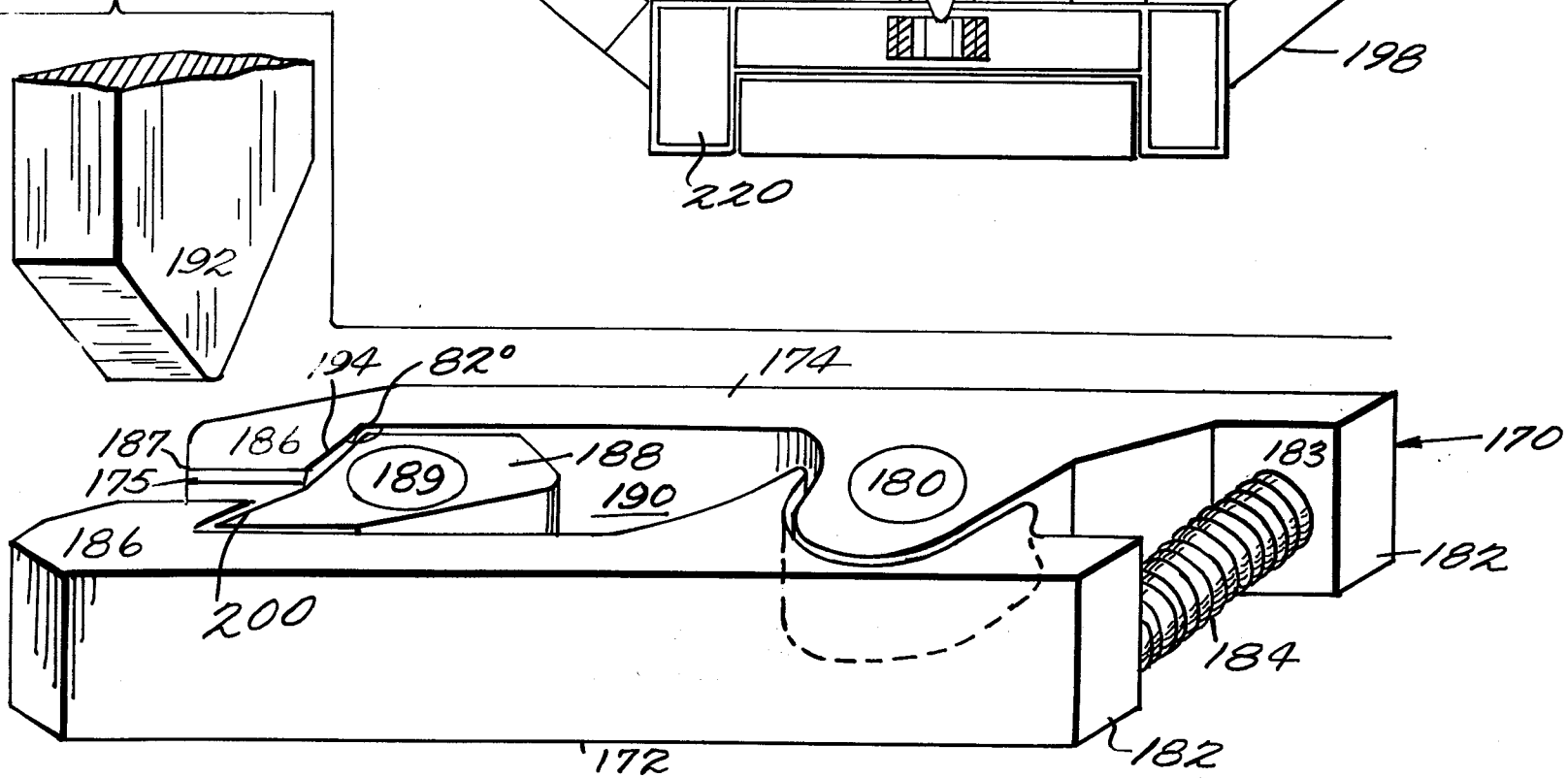
FIG. 5 is an enlarged perspective view of one embodiment of the receiving assembly showing the approach of a portion of a camming bar.

As previously indicated the pin 176 is removably mounted to the car bumper or housing and is placed into the respective aperture and bolted into place. Jaw member 172 rotatably rests on a washer spacer 178 which in turn rests on upper surface of the housing or bumper 168 of mine car 160. Jaw member 174 rotatably rests on the upper surface of jaw member 172. The jaw members 172 and 174 as seen in FIG. 5 each define an aperture 180 which is adapted to receive the pin 176 which extends down through the mine car housing or bumper 168 and the aperture formed by the washer spacer 178 so that both jaws rotate around the pin 176. The pin 176 is preferably formed with a head and one end threaded to receive a bolt not shown. The distal ends 182 of each of the jaw members are urged away from each other by a coil spring 184 which is secured or mounted in a spring seat on the end of each jaw member. The spring 184 is preferably welded to flat surfaces 183 on each end of the jaw members 172 and 174. If desired a leaf spring can be substituted for the coil spring.

The forward or receiving ends 186 of the arms of jaw members 172 and 174 are formed with a rearwardly angled front surface 187 which is adapted to guide an arrowhead member 188 into a receiving cavity or space 190 formed between the two jaw members 172 and 174. The upper inner surface 175 of each forward jaw end is beveled at a 30° angle so that a camming bar 192 which is used to uncouple the latch receiving assembly can easily force the jaw members apart against the spring action of spring 184. This camming bar is not provided with a slot section as wedge 154 is because in this embodiment the arrowhead member 188 is not provided with the T-section 90. The arrowhead shaped male member 188 is connected to the mine car bumper 82 solely by pin 86. The rear wall 194 of the forward end of the jaw members is cut at an 8° angle back towards the front to keep the arrowhead member 188 from spreading the jaw members while the cars are being pulled. Jaw member 174 as shown by the cross section FIG. 4 rotatably rides around pin 176 on the upper surface of jaw member 172 which in turn rotates around pin 176 on the upper surface of washer spacer 178.

Figure 3:
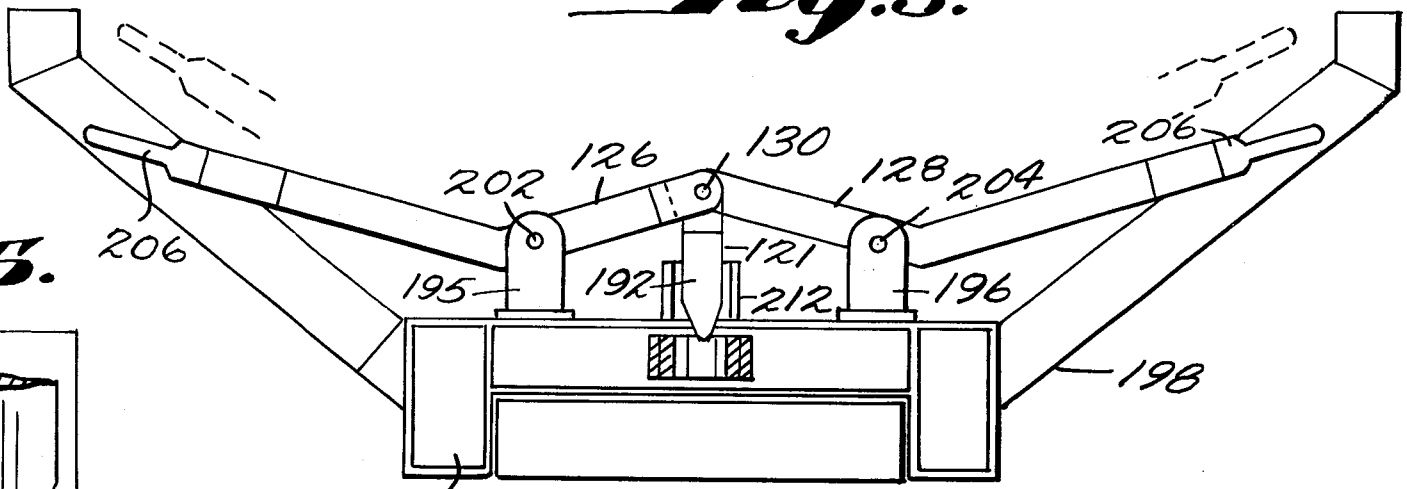
FIG. 3 is an enlarged cross-sectional view taken along line 3' — 3' of FIG. 1 when the mine car of FIG. 2 is coupled with the mine car of FIG. 1 as partially shown in FIG. 5.

The unlatching mechanism as shown by FIG. 3 comprises two lever arm supports 195 and 196 which are mounted on the mine car frame 198 on opposite sides of the coupling. Lever arms 126 and 128 are pivotally mounted on supports 195 and 196 by connecting pins 202 and 204. The lever arms 126 and 128 are provided on one end with handles 206 which enable the lever arms to be moved upwardly and downwardly around the rotatable pin means by the mine car operator. The opposite end of each lever arm is connected to a pin 130 secured to a camming bar 192. The apertures in the lever arms are shaped in the form of ovals in order to allow the camming bar 192 or latch block assembly 124 to move up and down. The camming bar 192 is guided in a specific directional path by means of its position within a sleeve 212 which is also secured to the mine car frame 198 by a pin 86 passing through the aperture 189. The latch block 188 is constructed with a dovetail rear surface 200 which is cut inward at 8° to form a suitable fit against the rear walls 194 of the forward ends 186 of the jaw members, thus keeping the jaw members from spreading while the cars are being pulled along. The front end of the latch block 188 is preferably constructed with an arrowhead shape so that it can engage and enter the space 190 formed by the jaws 172 and 174. Two guide arms 148 and 149 are secured to the mine car and angled inwardly to provide a guide for the receiving assembly so that receiving assembly 170 can easily engage the arrowhead latch block 188.

In operation the two cars are brought together until contact is made. The receiving assembly 170 is brought into contact with the latch block 188 which spreads the spring biased jaw members 172 and 174 apart and proceeds onward into space 190 formed between the two jaw members. As the jaw members are moved outward the spring 184 is bowed outward. When mine car 160 has moved toward mine car 84 a predetermined distance the jaw members 172 and 174 extend past the dovetailed rear surface 200 of the latch block 188 and the forward ends 186 of the jaw members are pushed together by spring 184 so that the rear wall surface 194 of the jaw member engages the rear dovetail surface 200 of the latch block 188. The inner surface of the jaw member engages the outer surface of the latch block so that the mine car can be pulled along with a minimum of sliding in the coupling.

When the car is desired to be uncoupled, lever arms 206 are grabbed by the operator and pulled upward, driving camming bar 192 down through sleeve 212 against the beveled edges 175 of the jaw members 172 and 174 spreading the jaws apart, thus allowing car 160 to be pulled from car 84. It should also be noted that a steel bumper 220 is positioned beneath the jaw members in the unlatching mechanism. The steel bumper 220 is a steel box with two big coil springs inside, one box being positioned on the end of each car, so that when the cars hit a bump the springs provide a buffering if the cars become jammed together.

While the preferred embodiment of the invention has been disclosed, it is understood that the invention is not limited to such an embodiment since it may be otherwise embodied in the scope of the appended claims.

What is claimed is:

1. A car coupling device comprising in combination a receiving assembly comprising a pair of jaw members pivotally mounted to each other, each jaw member including an arm having a hook shaped end, spring means mounted to each of said jaw members and acting upon the jaw members forcing their arms towards each other, a latch block assembly mounted to an adjacent car, said latch block assembly comprising an arrowhead shaped member mounted on said adjacent car, said arrowhead member comprising an arrowhead shaped portion and a "T" shaped stem secured to said arrowhead shaped portion, said arrowhead shaped portion defining an aperture adapted to receive pin means to hold said arrowhead shaped portion pivotally in place on a car, a cam assembly moveably mounted on said car above said arrowhead member, said cam assembly having a wedge shaped portion adapted to be reciprocated downward so that the wedge portion strokes the end of the jaw members forcing them apart against the action of the spring means a distance at least equal to the width of the arrowhead shaped member to allow the arrowhead shaped member to be withdrawn from the jaw members after it has coupled with the receiving assembly.

2. A car coupling device as claimed in claim 1 wherein the top inner surface of each jaw member end is beveled inward and the hooked shaped ends have a rear wall with a surface angled at least 8° with respect to the perpendicular from the side wall of the arm.

3. A car coupling device as claimed in claim 1 wherein said cam assembly comprises a wedge shaped cam member mounted in said latch block assembly defining a slot allowing said cam member to fit over at least a portion of said arrowhead shaped member.

4. A car coupling device as claimed in claim 3 wherein said wedge shaped cam member is supported by a "T" shaped stem comprising an arcuate top and an arcuate stem extending therefrom, said stem being of smaller diameter than said top.

5. A car coupling device as claimed in claim 1 wherein said latch block assembly compriss a body defining a chamber, said body being slidably mounted on a guide rod fixably mounted to said mine car, said latch block body also defining an ear with an aperture therethrough adapted for mounting said latch block assembly to moving means.

6. A car coupling device as claimed in claim 5 wherein said moving means comprises a pair of lever arms mounted to said ear.

7. A car coupling device as claimed in claim 1 wherein said spring means comprises a plurality of band springs biasing the distal ends of each of said jaw members towards each other.

8. A car coupling device as claimed in claim 1 wherein each jaw member has an arm member with parallel side walls, each jaw member having a vertical channel cut in one of said side walls adapted to receive the end of a spring means and a horizontal channel perpendicular to said vertical channel adapted to hold the body of said spring means.

9. A car coupling device as claimed in claim 1 wherein the hooked shaped ends define a frontal beveled surface and a top side beveled surface, a vertical front wall and a vertical rear wall extending at an angle from vertical parallel side walls.

10. A car coupling device as claimed in claim 1 including a pair of guide arms secured to said car above said arrowhead shaped member, said guide arms defining an inward angular configuration adaptd to guide said jaw members into engagement with said arrowhead member.

11. A mine car coupling mechanism comprising in combination a receiving assembly comprising a pair of jaw members pivotally mounted to each other by slidable pin means, each jaw member comprising an arm section having a hooked shaped distal end and a pivot section defining a throughgoing aperture adapted to slidably seat a pin means mounted therein, at least one "U" shaped band spring mounted around said jaw members biasing the ends of said jaw members toward each other, a latch block assembly mounted to an adjacent car opposite said receiving assembly, said latch block assembly comprising a latch block slidably mounted to said car, said latch block defining a cam holding chamber and a throughgoing aperture, a guide rod mounted in said throughgoing aperture, said guide rod being secured to said mine car, said latch block being adapted to slide along said guide rod, latch block moving means secured to said latch block and connected to means for lifting and lowering said latch block, an arrow shaped cam member mounted in said latch block, said arrowhead shaped cam member having a wedge shaped front section and defining a slot therein, an arrowhead shaped latch member mounted to said car, said cam member slot being adapted to slidably fit over said arrowhead shaped latch member and engage the distal ends of the arms of said jaw members when said jaw members are coupled with said arrowhead latch member so that the jaw arms forced apart a distance sufficient to allow said arrowhead member to be removed therefrom, said arrowhead latch member when inserted in said receiving assembly being seated in a cavity defined between said jaw member arms with the rear surface of said arrowhead latch member dovetailing into angularly cut rear surfaces of the jaw members ends.

12. A car coupling comprising in combination a pair of jaws having hook shaped heads at one end pivotally mounted to pin means on one car, spring means engaging the other end of said jaws to spread the rear ends of said jaws forcing said hooked heads towards each other, a latch block removably yet pivotally mounted to an adjacent car, the rear walls of said jaw heads and the rear walls of said latch block being angled to fit against each other in a dovetail arrangement when the jaws and latch block are coupled together, a reciprocating camming bar means mounted above said latch block, said reciprocating camming bar means comprising a plurality of levers pivotally mounted to said adjacent car, a wedge shaped block pivotally mounted to the ends of said levers, and sleeve means surrounding a portion of said block and adapted to guide said block downward into contact with said jaws, said reciprocating camming bar means being adapted to be inserted down into said jaws to force the jaw heads apart after said jaws have received said latch block to release said latch block.

13. Apparatus as claimed in claim 12 wherein said latch block has an arrowhead shaped front surface and a dovetailed shaped rear end surface with each of the dovetails angled and extending inwardly approximately 8°.

14. A car coupling device comprising in combination a receiving assembly comprising a pair of jaw members pivotally mounted to each other, each jaw member comprising a pivot portion and an arm portion, said pivot portion defining an oblong slot therein, pin means moveably mounted for positional displacement in said slot to pivotally connect said jaw members together, said arm portion having parallel side walls and a distal end forming a hooked shaped configuration, spring means mounted to each of said jaw members and acting upon the jaw members forcing their arms towards each other, a latch block assembly mounted to an adjacent car, said latch block assembly comprising an arrowhead shaped member mounted on said adjacent car and a cam assembly moveably mounted on said car above said arrowhead member, said cam assembly having a wedge shaped portion adapted to be reciprocated downward so that the wedge portion strikes the end of the jaw members forcing them apart against the action of the spring means a distance at least equal to the width of the arrowhead shaped member to allow the arrowhead shaped member to be withdrawn from the jaw members after it has coupled with the receiving assembly.

15. A car coupling as claimed in claim 14 wherein said hooked shaped end is formed with a substantially arcuate front surface, an inwardly beveled top surface and a rear wall formed at an angle to the inner side wall of the arm, said rear wall being cut at an angle to the inner side wall of the arm to conform and mate with the rear surface of the arrowhead member.

16. A car coupling device comprising in combination a receiving assembly comprising a pair of jaw members pivotally mounted to each other, each jaw member including an arm having a hook shaped end, spring means mounted to each of said jaw members and acting upon the jaw members forcing their arms towards each other, a latch block assembly mounted to an adjacent car, said latch block assembly comprising an arrowhead shaped member mounted on said adjacent car, said arrowhead shaped member comprising a body portion with angularly intersecting front walls, parallel side walls and rear walls inwardly inclined from said parallel side walls, and a "T" shaped stem integrally formed with and extending from said body portion, a cam assembly moveably mounted on said car above said arrowhead member, said cam assembly comprising a wedge shaped portion and a body portion defining a throughgoing aperture therein, said wedge shaped portion adapted to be reciprocated downward so that the wedge portion strikes the ends of the jaw members forcing them apart against the action of the spring means a distance at least equal to the width of the arrowhead shaped member to allow the arrowhead shaped member to be withdrawn from the jaw members after it has coupled with the receiving assembly.

17. A car coupling comprising in combination a pair of jaws having hook shaped heads at one end pivotally mounted to pin means on one car, spring means engaging the other end of said jaws to spread the rear ends of said jaws forcing said hooked heads towards each other, a latch block removably yet pivotally mountd to an adjacent car, the rear walls of said jaw heads and the rear walls of said latch block being angled to fit against each other in a dovetail arrangement when the jaws and latch block are coupled together, a reciprocating camming bar means mounted above said latch block, said reciprocating camming means being adapted to be inserted down into said jaws to force the jaw heads apart after said jaws have received said latch block to release said latch block, said car coupling further including guide bars connected to said adjacent car, said guide bars being directed inwardly at an angle to guide said pivoted jaws toward said latch block.

* * * * *